US009133070B2

(12) United States Patent
Min et al.

(10) Patent No.: US 9,133,070 B2
(45) Date of Patent: Sep. 15, 2015

(54) SMOKELESS PROPELLANT COMPOSITION CONTAINING BISMUTH-BASED COMPOUND AND METHOD OF PREPARING THE SAME

(71) Applicant: AGENCY FOR DEFENSE DEVELOPMENT, Daejeon (KR)

(72) Inventors: Byoung-Sun Min, Daejeon (KR); Moon-Sam Ryoo, Daejeon (KR); Seung-Won Ko, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 104 days.

(21) Appl. No.: 13/927,602

(22) Filed: Jun. 26, 2013

(65) Prior Publication Data

US 2014/0338803 A1 Nov. 20, 2014

(30) Foreign Application Priority Data

May 14, 2013 (KR) ..... 10-2013-0054396

(51) Int. Cl.

| | |
|---|---|
| ***C06B 25/00*** | (2006.01) |
| ***C06B 25/34*** | (2006.01) |
| ***D03D 23/00*** | (2006.01) |
| ***D03D 43/00*** | (2006.01) |
| ***C06B 21/00*** | (2006.01) |
| ***C06B 23/00*** | (2006.01) |
| ***C06B 45/00*** | (2006.01) |

(52) U.S. Cl.

CPC ..... *C06B 25/34* (2013.01); *C06B 21/0025* (2013.01); *C06B 23/007* (2013.01); *C06B 45/00* (2013.01)

(58) Field of Classification Search

USPC ..... 149/92, 88, 108.4, 109.4, 109.6

See application file for complete search history.

(56) References Cited

U.S. PATENT DOCUMENTS

| | | | | |
|---|---|---|---|---|
| 4,176,212 | A * | 11/1979 | Brack | 428/423.1 |
| H1341 | H * | 8/1994 | Hughes et al. | 149/19.4 |
| 6,168,677 | B1 | 1/2001 | Warren | |
| 2003/0089435 | A1 * | 5/2003 | Sanderson et al. | 149/19.1 |
| 2013/0054117 | A1 * | 2/2013 | Loeffler et al. | 701/104 |
| 2013/0056117 | A1 * | 3/2013 | Kim et al. | 149/88 |

FOREIGN PATENT DOCUMENTS

| | | | |
|---|---|---|---|
| JP | 05-070275 | A | 3/1993 |
| KR | 10-0205832 | B1 | 4/1999 |
| KR | 10-2004-0092810 | A | 11/2004 |
| KR | 10-2011-0128736 | A | 11/2011 |

* cited by examiner

*Primary Examiner* — James McDonough

(74) *Attorney, Agent, or Firm* — LRK Patent Law Firm

(57) ABSTRACT

A smokeless high-energy solid propellant composition, which contains a bismuth-based compound as a combustion improver and exhibits a low pressure exponent, and a method of preparing the same are provided. The propellant composition contains the bismuth-based compound, thus ensuring preparation processability of the propellant, especially pot-life, and thereby a propellant curing system can be changed thus ensuring reliability of the propellant preparation processability, unlike temperature control and curing inhibition catalyst addition methods published to date. This composition advantageously exhibits a low pressure exponent.

8 Claims, 1 Drawing Sheet

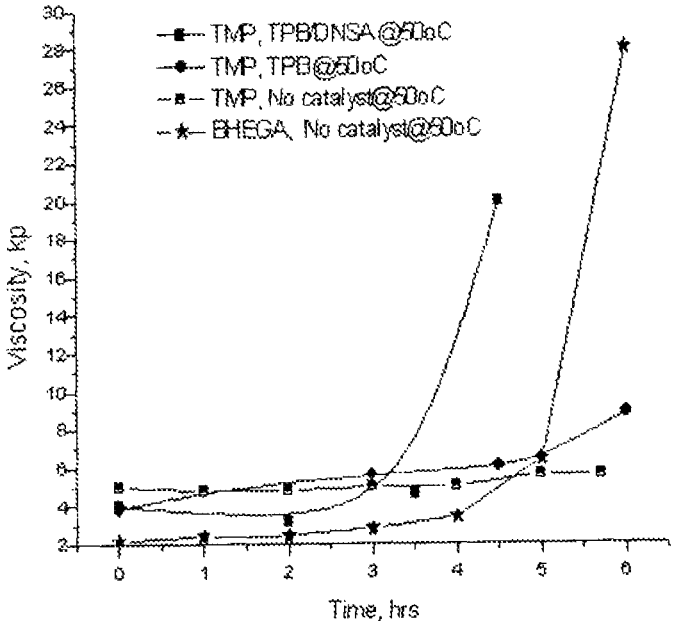
TMP, TPBDNSA @50oC
TMP, TPB@50oC
TMP, No catalyst@50oC
BHEGA, No catalyst@50oC
Viscosity, kp
Time, hrs
30
28
26
24
22
20
18
16
14
12
10
8
6
4
2
0
1
2
3
4
5
6

SMOKELESS PROPELLANT COMPOSITION CONTAINING BISMUTH-BASED COMPOUND AND METHOD OF PREPARING THE SAME

CROSS-REFERENCE TO RELATED APPLICATION

This application claims the benefit of Korean Patent Application No. KR 10-2013-0054396, filed May 14, 2013, which are hereby incorporated by reference in its entirety into this application.

BACKGROUND OF THE INVENTION

1. Technical Field

The present invention relates to a smokeless high-energy solid propellant composition, which contains a bismuth-based compound as a combustion additive and exhibits a low pressure exponent, and to a method of preparing the same.

2. Description of the Related Art

Nitrate ester polyether (NEPE)-based propellants typically contain, as a nitramine-based oxidizer, hexanitro hexaazaisowurtzitane (HNIW), cyclotrimethylene trinitramine (RDX), or cyclotetramethylene tetranitramine (HMX) therein. These compounds are eco-friendly because little or no smoke and no toxic gases are emitted upon combustion, compared to conventional hydroxy-terminated polybutadiene (HTPB) propellants including ammonium perchlorate (AP) that emits toxic hydrochloric acid gas. However, NEPE-based propellants have a high burning rate change exponent (pressure exponent, n) of 0.6 or more depending on changes in pressure, and are thus subject to high load pressure upon combustion. Hence, in order to decrease the pressure exponent, lead compounds or bismuth compounds are used. Recently, because lead compounds are environmentally harmful, the use thereof is restricted. For this reason, there are recent reports in which the pressure exponent is decreased using bismuth subsalicylate, chosen from among bismuth-based compounds, instead of the lead compounds. However, when using acid compounds such as bismuth subsalicylate or bismuth salicylate, a urethane reaction which is a propellant curing reaction is accelerated, making it impossible to ensure the propellant processing time, that is, pot-life. In order to ensure sufficient pot-life. U.S. Patent (U.S. Pat. No. 6,168,677 B1) discloses propellant mixing at 15° C. or less and casting. However, an additional cooling device is required, and propellant mixing at 15° C. or less may decrease propellant material mixing efficiency, and additional mixing time is required to perform cooling up to a temperature equal to or less than 15° C. and the viscosity of the propellant is also increased, and thus the casting process become problematic.

Accordingly, Korean Unexamined Patent Publication No. 10-2011-0128736 discloses a method of mixing a propellant at room temperature while adjusting the casting time using a tertiary amine compound. However, the above method is also problematic because the propellant is mixed at 50~60° C. upon initial propellant mixing, the temperature is gradually decreased, and a curing agent should be added at room temperature. Further, in the course of suppressing the accelerated curing reaction of bismuth subsalicylate using the tertiary amine compound, the tertiary amine is applied in different amounts every time, that is, reliability of the preparation processability may decrease. Moreover, because the amount of the added tertiary amine compound is very small, the propellant casting time may vary even by fine errors in the process of improving or adding materials.

CITATION LIST

Patent Literature (Patent Document 1) U.S. Pat. No. 6,168,677 B1

(Patent Document 2) Korean Unexamined Patent Publication No, 10-2011-0128736

SUMMARY OF THE INVENTION

Accordingly, the present invention has been made keeping in mind the above problems encountered in the related art, and an object of the present invention is to provide a smokeless high-energy solid propellant composition, which contains a bismuth-based compound as a combustion additive and exhibits a low pressure exponent, and a method of preparing the same.

The present invention provides a smokeless propellant composition, comprising, based on the total weight of the composition, 5.0~15.0 wt % of a binder prepolymer, including a polymer having a hydroxyl group (—OH) at a chain terminal: 10.0~70.0 wt % of an oxidizer; 1.0~5.0 wt % of a combustion improver, including bismuth subsalicylate or bismuth salicylate; 0.5~3.0 wt % of a urethane curing agent, including isophorone diisocyanate (IPDI); 0.1~1.5 wt % of a cross-linking agent, including trimethylol propane (TMP); and the remainder of one or more additives selected from the group consisting of a propellant aging stabilizer, a plasticizer, a combustion stabilizer, a burning catalyst, a neutral polymeric binder and a urethane curing catalyst.

In addition, the present invention provides a method of preparing a smokeless propellant, comprising curing the smokeless propellant composition at 40~50° C.

BRIEF DESCRIPTION OF THE DRAWING

The above and other objects, features and further advantages of the present invention will be more clearly understood from the following detailed description taken in conjunction with the accompanying drawing, in which:

FIG. 1 is a graph illustrating increases in temperature and viscosity of a propellant after mixing with or without a catalyst in a propellant composition.

DESCRIPTION OF THE PREFERRED EMBODIMENTS

Hereinafter, a detailed description will be given of the present invention.

The present invention pertains to a propellant composition, which may ensure preparation processability of a propellant containing a bismuth compound, especially casting time, and to a method of preparing the same, wherein a propellant curing system is changed thus ensuring reliability of the propellant preparation processability, unlike temperature control and curing inhibition catalyst addition methods published to date.

According to the present invention, a smokeless propellant composition comprises a binder prepolymer, an oxidizer, a combustion improver, a urethane curing agent, a cross-linking agent, a propellant aging stabilizer, a plasticizer, a combustion stabilizer, a burning catalyst, a neutral polymeric binder or a urethane curing catalyst.

In the smokeless propellant composition according to the present invention, the binder prepolymer is a polymer having a hydroxyl group (—OH) at a chain terminal, and functions to form a network through the reaction with a curing agent so that an energy material, that is, an oxidizer or a metal fuel, is held in the network. The binder prepolymer has a number average molecular weight of about 2,000~5,000 g/mol.

As the binder prepolymer used in the present invention, the polymer having a hydroxyl group (—OH) at the chain terminal is preferably any one or a mixture of two or more selected from the group consisting, of polyethylene glycol, polydiethylene glycol and polycaprolactone.

As the binder prepolymer, the polymer having a hydroxyl group (—OH) at the chain terminal is preferably added in an amount of 5.0~15.0 wt % based on the total weight of the smokeless propellant composition. If the amount thereof exceeds 15.0 wt %, the energy material, for example, the oxidizer or the metal fuel, may be added in a comparatively smaller amount, negatively affecting performance of the propellant. In contrast, if the amount thereof is less than 5.0 wt %, the propellant may not be elastic, and may thus become weak to external impact.

In the smokeless propellant composition according to the present invention, the oxidizer plays a role in supplying oxygen upon combustion. The oxidizer used in the present invention is preferably any one or a mixture of two or more selected from the group consisting of hexanitro hexaazaisowurtzitane (HNIW), cyclotrimethylene trinitramine (RDX), cyclotetramethylene tetranitramine (HMX) and ammonium nitrate (AN).

The oxidizer is preferably added in an amount of 10.0~70.0 wt % based on the total weight of the smokeless propellant composition. If the amount thereof exceeds 70.0 wt %, the viscosity of the propellant may remarkably increase, undesirably deteriorating preparation processability and mechanical properties of the propellant. In contrast, if the amount thereof is less than 10.0 wt %, the amount of oxygen necessary for combustion of the propellant may decrease, and thus combustion becomes unstable.

In the smokeless propellant composition according to the present invention, the combustion improver is an eco-friendly material and is very effective at improving combustion properties.

The combustion improver used in the present invention includes bismuth subsalicylate or bismuth salicylate.

The combustion improver is preferably added in an amount of 1.0~5.0 wt % based on the total weight of the smokeless propellant composition. If the amount thereof exceeds 5.0 wt %, a desired effect is not attained, and the amount of the energy material, for example, the oxidizer or the metal fuel, may decrease, undesirably causing energy loss. In contrast, if the amount thereof is less than 1.0 wt %, the effect of the combustion improver may become very insignificant.

In the smokeless propellant composition according to the present invention, the urethane curing agent includes isophorone diisocyanate (IPDI). The urethane curing agent is preferably added in an amount of 0.5~3.0 wt % based on the total weight of the smokeless propellant composition. If the amount thereof exceeds 3.0 wt %, hardness of the propellant becomes excessively high, undesirably facilitating generation of cracks. In contrast, if the amount thereof is less than 0.5 wt %, the propellant curing reaction may not occur.

A conventional curing system which has been used in the prior inventions includes a polymer having a hydroxyl group functional exponent of 2.0 or less and a polyfunctional isocyanate curing agent such as N-3200 or N-100 having an isocyanate functional exponent of 2.0 or more. When the polyfunctional curing agent having high reactivity is applied to the propellant containing bismuth subsalicylate, the curing rate is drastically increased, compared to typical propellants, and thus the casting time may be only ones of minutes at 50° C. which is a typical propellant mixing temperature. However, isophorone diisocyanate (IPDI), which is the bifunctional curing agent used in the present invention, has a lower curing rate, compared to the polyfunctional isocyanate.

The smokeless propellant composition according to the present invention includes, as the cross-linking agent, trimethylol propane (TMP) and additionally bis-(2-hydroxyethyl)glycolamide (BHEGA). Because polymer chains are not cross-linked only by the prepolymer and the curing agent having hydroxyl group and isocyanate functional exponents of 2.0 or less, trimethylol propane (TMP) is added in a small amount in the present invention, whereby the polymer chains may be cross-linked from trimethylol propane (TMP) corresponding to the cross-linking initiation point. Bis-(2-hydroxyethyl)glycolamide (BHEGA) is used as the cross-linking agent together with TMP, so that the propellant is cured. The cross-linking agent is preferably added in an amount of 0.1~1.5 wt % based on the total weight of the smokeless propellant composition. If the amount thereof exceeds 1.5 wt %, the amount of the binder prepolymer is low, so that the propellant is not elastic, undesirably deteriorating mechanical properties. In contrast, if the amount thereof is less than 0.1 wt %, the propellant is not cured.

In the smokeless propellant composition according to the present invention, the propellant aging stabilizer includes any one or a mixture of two or more selected from the group consisting of N-methyl nitroaniline (NMA) and 2-nitrodiphenylamine (2-NDPA). The propellant aging stabilizer is preferably added in an amount of 0.1~1.5 wt % based on the total weight of the smokeless propellant composition. If the amount thereof exceeds 1.5 wt %, a more superior effect is not manifested due to the addition thereof. In contrast, if the amount thereof is less than 0.1 wt %, the effect of the stabilizer becomes very insignificant.

In the smokeless propellant composition according to the present invention, the plasticizer in eludes any one or a mixture of two or more selected from the group consisting of materials having a nitroester group, for example, 1,2,4-butanetriol trinitrate (BTTN), trimethylolethane trinitrate (MUM and diethylene glycol dinitrate (DEGDN). Further, the smokeless propellant composition includes, as the plasticizer, a material having a nitramine group, for example, n-butyl nitroxyethylnitramine (n-BuNENA). The plasticizer is preferably added in an amount of 10.0~80.0 wt % based on the total weight of the smokeless propellant composition, lithe amount thereof exceeds 80.0 wt %, the energy material in the propellant, for example, the oxidizer or metal fuel particles, may precipitate. In contrast, if the amount thereof is less than 10.0 wt %, it is impossible to prepare the propellant in the case of the binder prepolymer in a solid phase at room temperature.

In the smokeless propellant composition according to the present invention, the combustion stabilizer, for example, zirconium carbide, is preferably added in an amount of 0.5~3.0 wt % based on the total weight of the smokeless propellant composition. The case where the amount thereof exceeds 3.0 wt % has a significant influence on deteriorating performance of the propellant. In contrast, if the amount thereof is less than 0.5 wt %, the effect of the combustion stabilizer becomes very insignificant.

In the smokeless propellant composition according to the present invention, the burning catalyst is used to control the burning rate and the pressure exponent.

In the present invention, the burning catalyst, for example, carbon black, is preferably added in an amount of 0.1~1.0 wt % based on the total weight of the smokeless propellant composition. If the amount thereof exceeds 1.0 wt %, the effect thereof is not further exhibited, and performance of the propellant may deteriorate. In contrast, if the amount thereof is less than 0.1 wt %, a synergistic effect with the combustion improver, for example, the bismuth compound, cannot be manifested.

In the smokeless propellant composition according to the present invention, the neutral polymeric binder, for example, an acrylonitrile-2-hydroxyethyl acrylate copolymer, is preferably added in an amount of 0.1~0.6 wt % based on the total weight of the smokeless propellant composition. If the amount thereof exceeds 0.6 wt %, mechanical properties of the propellant may deteriorate, and poor processability may result. In contrast, if the amount thereof is less than 0.1 wt %, physical/chemical adsorption between the network in the propellant and the oxidizer cannot take place, and thus there are no improvements in mechanical properties of the propellant.

In the smokeless propellant composition according to the present invention, the urethane curing catalyst, for example, triphenylbismuth (TPB), is preferably added in an amount of 0.05~0.3 wt % based on the total weight of the smokeless propellant composition. If the amount thereof exceeds 0.3 wt %, the propellant curing rate becomes excessively high. In contrast, if the amount thereof is less than 0.05 wt %, the propellant is not cured or the curing rate of the propellant is considerably decreased.

In addition, the present invention pertains to a method of preparing a propellant comprising curing the smokeless propellant composition at 40~50° C. Upon preparation in the above temperature range, the volatile material may be removed from the propellant, and the viscosity of the propellant is low and thus the mixing process and the filling efficiency in the motor become good. In the preparation of the propellant according to the present invention, mixing is performed in a vacuum at 65° C. before addition of an insoluble solid such as an oxidizer corresponding to initial propellant mixing using a planetary mixer, and mixing is performed in a vacuum at 50° C. upon sequential addition of the oxidizer, thus preparing a propellant slurry, and curing is carried out at 50° C. for one week.

As shown in FIG. 1, the use of isophorone diisocyanate (IPDI) and trimethylol propane (TMP) make it possible to sufficiently ensure the propellant casting time (pot-life) of 5 hr or longer at 50° C., and also the pot-life may be sufficiently ensured for 5 hr or longer in the presence of the urethane curing catalyst such as triphenylbismuth. However, when a co-catalyst, for example, dinitrosalicylic acid (DNSA), is used together with triphenylbismuth (TPB), the viscosity of the propellant is drastically increased in 3 hr (TMP, TPB/DNSA @50° C.—tensile strength 6.3 bar, elongation 90%, elastic modulus 14 bar, hardness 43, burning rate (@1,000 psi)=12.2 mm/sec, pressure exponent 0.400).

A better understanding of the present invention may be obtained via the following examples which are set forth to illustrate, but are not to be construed as limiting the present invention.

EXAMPLE 1

A mixture comprising 6.6 wt % of a polyethyleneglycol polymer (PEG)/IPDI, 0.4 wt % of TMP, 22.2 wt % of butanetriol trinitrate, 7.0 wt % of trimethylolethane trinitrate, 30 wt % of 2,4,6,8,10,12-hexanitro-2,4,6,8,10,12-hexaazaisowurtzitane (HNIW), 29 wt % of 1,3,5-trinitroperhydro-1,3,5-triazine (RDX), 0.8 wt % of N-methyl para-nitroaniline (NMA), 0.3 wt % of an acrylonitrile-2-hydroxyethyl acrylate copolymer as a neutral polymeric binder, 1.3 wt % of zirconium carbide as a combustion stabilizer, and 0.4 wt % of carbon black as a burning catalyst, was added with 2.0 wt % of bismuth subsalicylate as a combustion improver and mixed together, wherein mixing was performed in a vacuum at 65° C. before addition of an insoluble solid such as an oxidizer corresponding to initial propellant mixing using a planetary mixer, and mixing was performed in a vacuum at 50° C. upon sequential addition of the oxidizer, thus preparing a propellant slurry, and curing was conducted at 50° C. for one week; tensile strength 5.7 bar, elongation 119%, elastic modulus 13.5 bar, hardness 40, burning rate (@1,000 psi)=11.94 mm/sec, pressure exponent 0.394.

EXAMPLE 2

A mixture comprising 6.5 wt % of a polyethyleneglycol polymer (PEG)/IPDI, 0.4 wt % of TMP, 22.2 wt % of butanetriol trinitrate, 7.0 wt % of trimethylolethane trinitrate, 30 wt % of 2,4,6,8,10,12-hexanitro-2,4,6,8,10,12-hexaazaisowurtzitane (HNIW), 29 wt % of 1,3,5-trinitroperhydro-1,3,5-triazine (RDX), 0.8 wt % of N-methyl para-nitroaniline (NMA), 0.3 wt % of an acrylonitrile-2-hydroxyethyl acrylate copolymer as a neutral polymeric binder, 1.3 wt % of zirconium carbide as a combustion stabilizer, 0.4 wt % of carbon black as a burning catalyst, and 0.1 wt % of triphenylbismuth (FPB) as a urethane curing catalyst, was added with 2.0 wt % of bismuth subsalicylate as a combustion improver and mixed together, wherein mixing was performed in a vacuum at 65° C. before addition of an insoluble solid such as an oxidizer corresponding to initial propellant mixing using a planetary mixer, and mixing was performed in a vacuum at 50° C. upon sequential addition of the oxidizer, thus preparing a propellant slurry, and curing was conducted at 50° C. for one week; tensile strength 7.0 bar, elongation 73%, elastic modulus 16.6 bar, hardness 46, burning rate (@1,000 psi)=11.95 mm/sec, pressure exponent 0.406.

EXAMPLE 3

A mixture comprising 6.6 wt % of a polyethyleneglycol polymer (PEG)/IPDI, 0.4 wt % of BHEGA, 22.2 wt % of butanetriol trinitrate, 7.0 wt % of trimethylolethane trinitrate, 30 wt % of 2,4,6,8,10,12-hexanitro-2,4,6,8,10,12-hexaazaisowurtzitane (HNIW), 29 wt % of 1,3,5-trinitroperhydro-1,3,5-triazine (RDX) 0.8 wt % of N-methyl para-nitroaniline (NMA), 0.3 wt % of an acrylonitrile-2-hydroxyethyl acrylate copolymer as a neutral polymeric binder, 1.3 wt % of zirconium carbide as a combustion stabilizer, and 0.4 wt % of carbon black as a burning catalyst, was added with 2.0 wt % of bismuth subsalicylate as a combustion improver and mixed together, wherein mixing was performed in a vacuum at 65° C. before addition of an insoluble solid such as an oxidizer corresponding to initial propellant mixing using a planetary mixer, and mixing was performed in a vacuum at 50° C. upon sequential addition of the oxidizer, thus preparing a propellant slurry, and curing was conducted at 50° C. for one week; tensile strength 6.6 bar, elongation 142%, elastic modulus 12.8 bar, hardness 40, burning rate ((@1,000 psi)=mm/sec, pressure exponent 0.372.

According to the present invention, preparation processability of a propellant containing a bismuth compound, especially casting time, can be ensured, and thus a propellant curing system can be changed, thereby ensuring reliability of the propellant preparation processability and exhibiting a low pressure exponent, unlike temperature control and curing inhibition catalyst addition methods published to date.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A smokeless propellant composition, comprising:

based on a total weight of the composition, 5.0~15.0 wt % of a binder prepolymer, including a polymer having a hydroxyl group (—OH) at a chain terminal;

10.0~70.0 wt % of an oxidizer;

1.0~5.0 wt % of a combustion improver, including bismuth subsalicylate or bismuth salicylate;

0.5~3.0 wt % of a urethane curing agent, including isophorone diisocyanate (IPDI);

0.1~1.5 wt % of a cross-linking agent, including trimethylol propane (TMP); and a remainder of one or more additives selected from the group consisting of a propellant aging stabilizer, a plasticizer, a combustion stabilizer, a burning catalyst, a neutral polymeric binder and a urethane curing catalyst wherein the combustion stabilizer is zirconium carbide and is used in an amount of 0.5~3.0 wt % based on the total weight of the smokeless propellant composition, wherein the burning catalyst is carbon black and is used in an amount of 0.1~1.0 wt % based on the total weight of the smokeless propellant composition, and wherein the urethane curing catalyst is triphenylbismuth (TPB), and is used in an amount of 0.05~0.3 wt % based on the total weight of the smokeless propellant composition.

2. The smokeless propellant composition of claim 1, wherein, as the binder prepolymer, the polymer having a hydroxyl group (—OH) at the chain terminal is any one or a mixture of two or more selected from the group consisting of polyethylene glycol, polydiethylene glycol and polycaprolactone.

3. The smokeless propellant composition of claim 1, wherein the oxidizer is any one or a mixture of two or more selected from the group consisting of hexanitro hexaazaisowurtzitane (HNIW), cyclotrimethylene trinitramine (RDX), cyclotetramethylene tetranitramine (HMX) and ammonium nitrate (AN).

4. The smokeless propellant composition of claim 1, wherein the cross-linking agent further includes bis-(2-hydroxyethyl)glycolamide (BHEGA).

5. The smokeless propellant composition of claim 1, wherein the propellant aging stabilizer is any one or a mixture of two or more selected from the group consisting of N-methyl nitroaniline (NMA) and 2-nitrodiphenylamine (2-NDPA), and is used in an amount of 0.1~1.5 wt % based on the total weight of the smokeless propellant composition.

6. The smokeless propellant composition of claim 1, wherein the plasticizer is any one or a mixture of two or more selected from the group consisting of 1,2,4-butanetriol trinitrate (BTTN), trimethylolethane trinitrate (TMETN), diethylene glycol dinitrate (DEGDN) and n-butyl nitroxyethylnitramine (n-BuNENA), and is used in an amount of 10.0~80.0 wt % based on the total weight of the smokeless propellant composition.

7. The smokeless propellant composition of claim 1, wherein the neutral polymeric binder is an acrylonitrile-2-hydroxyethyl acrylate copolymer, and is used in an amount of 0.1~0.6 wt % based on the total weight of the smokeless propellant composition.

8. A method of preparing a smokeless propellant, comprising curing the smokeless propellant composition of claim 1 at 40~50° C.

* * * * *